United States Patent [19]

Adams et al.

[11] 4,067,449

[45] Jan. 10, 1978

[54] APPARATUS FOR HIGH-SPEED ACCURATE COUNTING AND HANDLING OF DISCRETE OBJECTS SUCH AS TABLETS

[75] Inventors: Jim Mills Adams, West Caldwell; Edward Francis deZabala, Pequannock, both of N.J.

[73] Assignee: Hoffmann-La Roche Inc., Nutley, N.J.

[21] Appl. No.: 623,527

[22] Filed: Oct. 16, 1975

Related U.S. Application Data

[62] Division of Ser. No. 543,238, March 21, 1974, Pat. No. 3,997,063.

[51] Int. Cl.[2] ..... G06M 9/00

[52] U.S. Cl. ..... 214/1 C

[58] Field of Search ..... 214/1 C, 1 R; 221/2, 221/7; 53/59 R, 78; 235/92 V, 92 DN; 425/135, 140, 141, 149; 15/303, 316 R, 339, 405

[56] References Cited

U.S. PATENT DOCUMENTS

| | | | |
|---|---|---|---|
| 2,850,239 | 9/1958 | Polanyi et al. | 235/92 DN |
| 3,000,331 | 9/1961 | Frank | 425/140 X |
| 3,063,390 | 11/1962 | Frank | 425/140 |
| 3,081,588 | 3/1963 | Klapes et al. | 53/78 |
| 3,677,437 | 7/1972 | Haigler | 221/7 |
| 3,760,166 | 9/1973 | Adams et al. | 235/92 V X |
| 3,835,306 | 9/1974 | Bills et al. | 235/92 V X |
| 3,836,299 | 9/1974 | Houston et al. | 425/140 X |
| 3,837,139 | 9/1974 | Roseberg | 221/7 X |

FOREIGN PATENT DOCUMENTS

| | | | |
|---|---|---|---|
| 1,216,397 | 12/1970 | United Kingdom | 214/1 C |

*Primary Examiner*—Frank E. Werner

*Attorney, Agent, or Firm*—Samuel L. Welt; George M. Gould; Mark L. Hopkins

[57] ABSTRACT

There is disclosed a highly accurate counting and handling arrangement particularly adaptable to large-volume, high-speed multiple-output apparatus producing discrete, solid particular objects, such as tablets. Sensing means, preferably retroreflective optical sensors, fluidic sensors or strain-gauge sensing arrangements, are employed in associated with existing apparatus to detect each object at the point where the objects are substantially completely formed. The signals generated by the individual sensors are received by a control counter arrangement which provides a continuous separate displayed counting for each sensor employed. The control counter arrangement has provision for separately presetting the maximum desired count of sensed objects for each sensor employed. A gated dispensing assembly is additionally provided in association with each sensor employed which is adapted to predeterminably control the procession of the objects from their point of virtual completion to a pre-established distination under the supervision of the respective separate maximum preset facility of the control counter arrangement.

17 Claims, 21 Drawing Figures

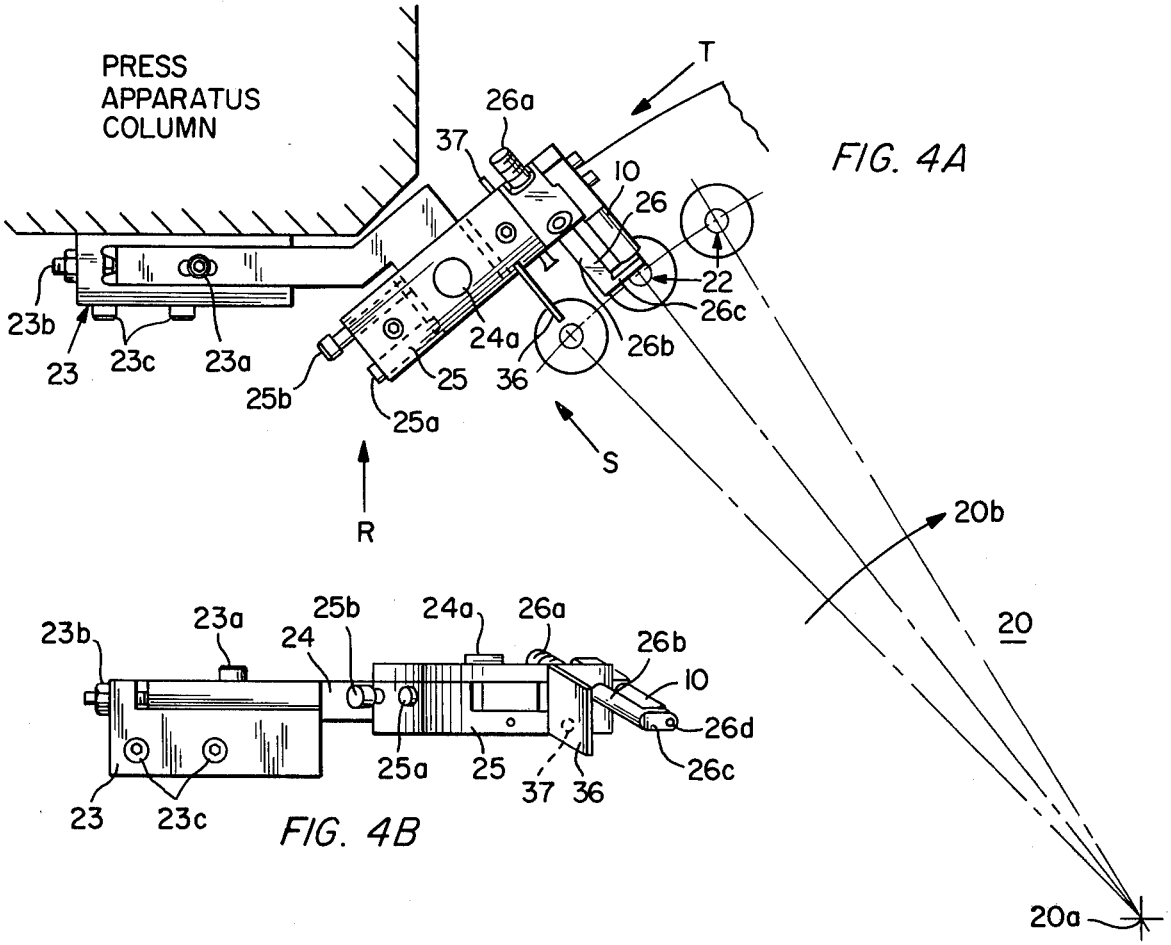
FIG. 4A
FIG. 4B
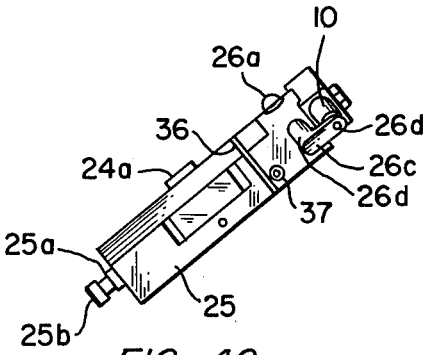
FIG. 4C
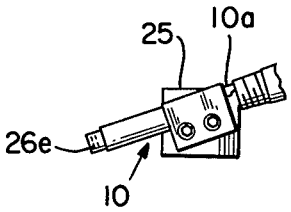
FIG. 4D
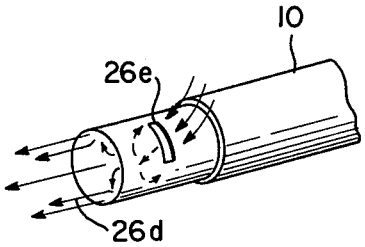
FIG. 4E

PRESS APPARATUS FRAME
52
53a
53b
61b
61a
61
60
C
C
69

TABLETS
LOOSE TABLET POWDER
61
62

66
67
65
63
62
64
61
60
70

APPARATUS FOR HIGH-SPEED ACCURATE COUNTING AND HANDLING OF DISCRETE OBJECTS SUCH AS TABLETS

This is a division, of application Ser. No. 543,238 filed Mar. 21, 1974 now U.S. Pat. No. 3,997,063, issued Dec. 14, 1976.

BACKGROUND OF THE INVENTION

This invention relates to improvements in high-speed apparatus manufacturing discrete, solid particular objects, such as tablets, and more particularly to high-speed, accurate counting and processing of the objects produced by such apparatus.

With the advent of recent legislation involving controlled substances, and in an effort to deal with greater and greater production demands requiring also a substantial degree of accuracy, the problem is acutely recognized that the combined features of very accurate, high-speed and large-volume counting and handling (or processing) of such objects as tablets are not available in or with existing apparatus. For the most part counting is presently accomplished in bulk by weight measurement which precedure has been shown to be inadequate where, for example, a high level of accuracy is important, particularly in high-speed, large-volume production operations. Moreover, the need particularly remains unfulfilled as to high-speed, accurate counting and handling arrangements adaptable to dual or multiple output production apparatus, i.e. apparatus simultaneously providing two or more continuous output streams of solid particular objects.

Present desired criteria sought in the pharmaceutical industry include, as example, the capability that $10^6$ units such as tablets be counted and processed per hour with an accuracy of 0.01%. To this are added such other desired features or criteria as adaptability to varying forms of high-speed apparatus, simplicity of arrangement, ease and minimal need of maintenance, compactness, reasonable cost and long-life.

SUMMARY OF THE INVENTION

It is, therefore, a principal object of this invention to provide a counting and handling arrangement which is readily adaptable to existing high-speed apparatus producing discrete, solid particular objects, such as tablets, particularly in large volume production operations, and having the desired criteria above-mentioned including the capability of $10^6$ units being counted and processed per hour with an accuracy of 0.01%.

According to the broader aspects of the invention, there is provided an ultra-accurate counting and handling system for use with high-speed apparatus making discrete, solid particular objects, comprising sensing means including a directional sensor arrangement predeterminably arranged relative to each station of the apparatus at which the formation of the objects is virtually completed, each said sensor arrangement having an optical face proximate said station to which it is associated; control counter means responsive to the sensing means for providing a separate continuous count of the objects sensed by each said sensor arrangement, said counter means including first means enabling a separate presetting of the maximum desired count of the sensed objects for each said station of the apparatus; and gating and handling means including a gated dispensing arrangement associated with each said station of the apparatus having a first portion thereof situate proximate the respective stations, each said gated dispensing arrangement being adapted to predeterminably control the procession of the tablets from said respective station of the apparatus to a pre-established destination under the supervision of said first means.

Moreover, there is provided improved tablet making apparatus, in which via at least two separate but identical operations a predetermined amount of a powder substance is introduced into successive ones of a multiplicity of dies in a moving member where it is pressed into tablets, the tablets then being ejected from the dies at a pre-established station for subsequent collection into containers, wherein the improvement comprises sensing means including a retroreflective optical sensor arrangement positioned relative to each of said tablet ejection stations associated with the rotating member and arranged to sense a properly formed tablet when the same is substantially fully ejected from its die; and control counter means responsive to said sensing means for providing a separate continuous count of the tablets sensed by each sensor arrangement.

A feature of the invention is that the same is adaptable to a great many different types of solid particular objects having a substantially uniform shape, wherein it is desirable to have accurate counting, and particularly in high-speed, large-volume operations. Thus, the advantages of high accuracy and high-speed, as well as large volume handling, which this invention provides, are available, for example, with regard to coin minting, candy products, and so on.

BRIEF DESCRIPTION OF THE DRAWINGS

The above objects and features, as well as the invention itself, will become better understood with reference to the following detailed description, taken in conjunction with the accompanying drawings, in which:

FIG. 4A diagrammatically illustrates a top view of an adjustable optical sensing and air purge arrangement arranged above a rotating tablet press die table;

FIGS. 4B–4D represent diagrammatical side views of portions of the optical sensing and air purge arrangement of FIG. 4A taken respectively in the directions indicated as R, S and T;

FIG. 4E is an enlarged, partially-fractionalized schematic representation of a portion of the air purge arrangement in association with the sensor depicted in FIGS. 4A–4D, illustrating the purging action in relation to the operative face of the latter;

DESCRIPTION OF THE PREFERRED EMBODIMENT(S)

Figure 1A:
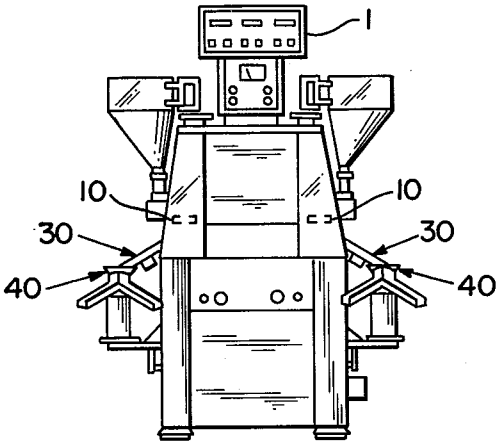
FIGS. 1A and 1B are diagrammatic front and side views respectively of a high-speed rotary tablet press apparatus incorporating counting and handling arrangement according to the invention.
Figure 1B:
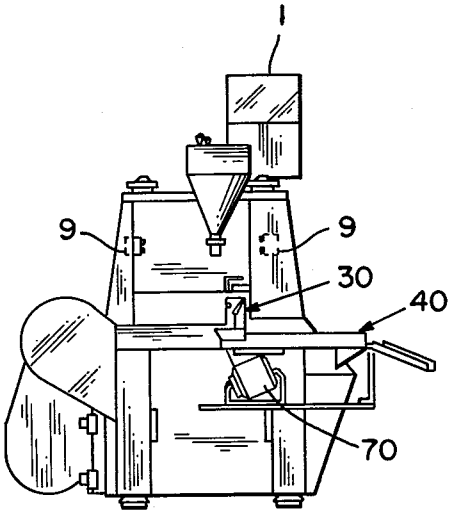

FIGS. 1A and 1B illustrate diagrammatically in front and side views respectively an existing high-speed rotary tablet press incorporating the principals of the invention. The particular press apparatus depicted herein, by way of example, is the Manesty Rotapress Mark II. This apparatus is of the dual-operation type. That is, there is provided a pair of tablet press and ejection stations opposite one another relative to a horizontally arranged rotary die table or wheel. Therefore, application of the invention to the Manesty press involves in large part a duality of apparatus, in conformity with the simultaneous dual tablet production.

The electronics package utilized for counting the tablets as they are sensed, which is represented in FIGS. 1A and 1B by the console 1, may be that disclosed in commonly assigned U.S. Pat. No. 3,760,166, wherein there is disclosed inter alia a counting apparatus capable of being employed in a two-channel capacity for a dual-operation tablet press apparatus, as herein, or it may be used, for example, in the random counting of tablets or capsules passing through, for example, up to 32 channels. This counter arrangement provides a digital display of each of the dual counts as well as a continuously updated total of the two.

Shown schematically in addition to the console 1, in association with the press apparatus in FIGS. 1A and 1B, are dual sensors 10, dual gate assemblies 30 and dual deduster assemblies 40, all of which represent various aspects of the invention.

Figure 2:
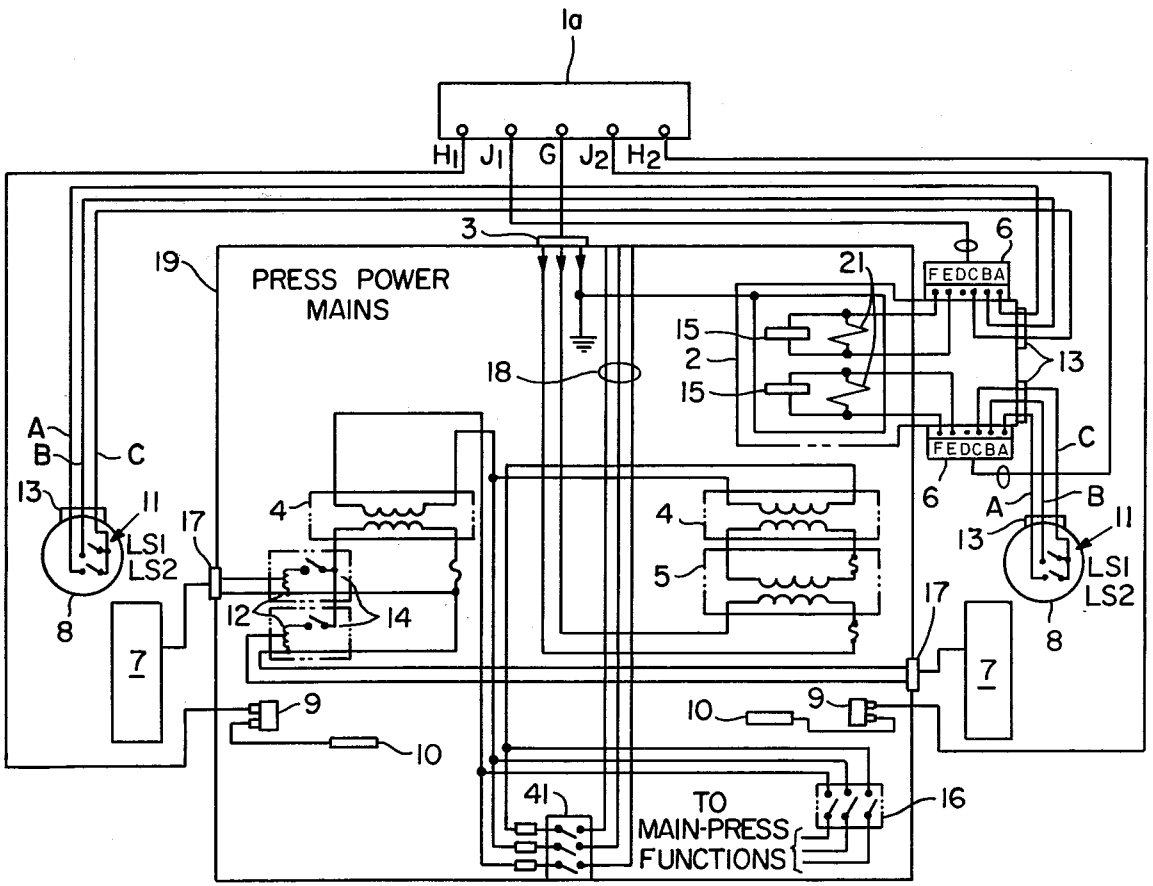
FIG. 2 is a schematic illustration of the electrical circuitry aspects of the invention in association with the apparatus depicted in FIGS. 1A and 1B.

FIG. 2 illustrates in schematic form the electrical aspects of the invention in association with the existing electrical provisions of the depicted apparatus. As shown therein, there is provided in the existing circuitry of the Press control assembly 19 typical three-phase power mains 18 leading in from an outside power source, the same being coupled in customary manner through appropriate existing on-off switching 41 to a pair of step-down transformers 4. The output side of one step-down transformer is in turn input-coupled to an isolation transformer 5, whose output constitutes the power input to counter arrangement 1*a* via line designed C7 as coupled by way of connector 3. The advantage of this transformer combination is that counter 1*a* is rendered virtually unaffected by line power variations. It is noted, however, by this power supply arrangement that if an operator were required to shut the press apparatus down, for example, due to a malfunction, the counter 1*a* would also be deactivated, thus giving rise to the very real danger of losing a tablet count well in progress. In order to avoid this situation, alternative power switching 16 is provided which is appropriately tied to the equipment side of switching means 41 on the one hand, and to the remainder of the main press functions, on the other hand. In this way, switching means 41 may be locked closed at all times that a count is in progress, whereas if a malfunction appears anywhere in the remainder of the entire apparatus, or some other reason arises for shutting down the press, switching means 16 is now available to perform this function.

Of the remaining leads associated with counter 1*a*, two of the leads, i.e. $H_1$ and $H_2$, couple to dual sensor amplifiers 9, which amplifiers in turn are coupled to dual tablet sensors 10, and the remaining two leads shown, i.e. $S_1$ and $S_2$, which are actually five-wire cables, terminate at multi-lead connectors 6. The sensors 10 are here schematically representative of three different preferred types of sensor arrangements, namely optical, fluidic, and strain-gauge type, each of which will be treated in greater detail hereinafter.

The other step-down transformer 4 is output-coupled to dual deduster controls 12 which comprise deduster switches 14 leading to the dual deduster/vibrator assemblies 7 via connectors 17. The A, B and C leads of connectors 6 are respectively coupled via connectors 13 to dual limit switch arrangements 11, each including a pair of limit switches $LS_1$ and $LS_2$. The limit switch arrangements 11 respectively comprise part of dual gate actuator arrangements 8. The E and F leads of connectors 6 are coupled respectively to one-half of an actuator valve assembly 2, which includes dual valve solenoids 21 respectively coupled in paralled to suppressors 15.

Operationally, it should be kept in mind that since the tablet press apparatus is producing tablets from the rotary die table simultaneously on opposite sides or stations thereof, the invention takes into consideration the need for providing identical and separate means for sensing and handling the tablets as and when they are produced. In this regard, the single counter assembly 1*a* employs separate counting channels which log and display the respective counts derived from the simultaneous and separate tablet production, the totals of which are continuously summed and displayed.

A detailed description herein, however, will be with reference to one side of the overall dual operation only, it being recognized that both sides operate in the same manner.

In a first preferred embodiment use is made of identical optical retroreflective sensors 10 (FIG. 4D), such as the coaxial fiber optic retroreflective sensor Model S322-3, manufactured by the Skan-a-matic Corporation. One such optical sensor is shown mounted relative to the press die table 20 in FIG. 4A. As will be described in greater detail hereinafter with reference to FIGS. 5A and 5B, a pressed tablet is sensed by the retroreflective sensor 10 as it is almost fully ejected from its die, and in particular when it is roughly 90% ejected from its die. The signal generated by sensor 10 is amplified by the sensor amplifier 9, which signal is then conveyed to the one channel of counter 1*a* where it is logged and displayed. There is provision in the counter arrangement 1*a* for "thumbwheel" rotary switch means and associated circuitry, by which a predetermined maximum desired count for that channel can be set (e.g. 180,000 tablets). This "preset" circuitry is of conventional type. The system continues to operate in the manner as briefly described above until the preselected maximum count is reached.

Figure 6A:
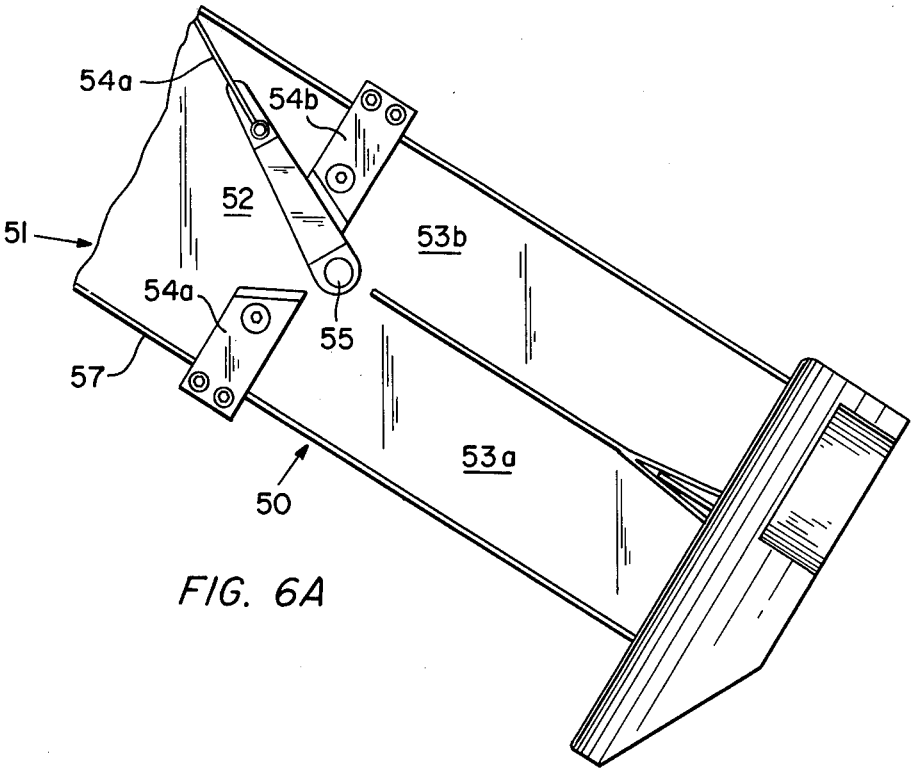
FIG. 6A is a diagrammatic plan view of a tablet diverting gating assembly according to the invention.

The tablets, once ejected from the die wheel, are immediately directed off of the rotating die table by a scraper blade angularly disposed relative to the direction of rotation thereof (not particularly shown). The blade is situated just beyond the sensor in the direction of rotation of the press die wheel (indicated by the arrow 20*b* in FIG. 4A). From there the tablets are immediately led into the mouth portion 51 of a tablet-diverting gate mechanism or assembly 50 (FIG. 6A). Once the tablets enter the mechanism 50, they are directed by a gate 52 into one or the other of a pair of parallelly extending continguous U-shaped channels or chutes 53*a* and 53*b*.

Figure 6B:
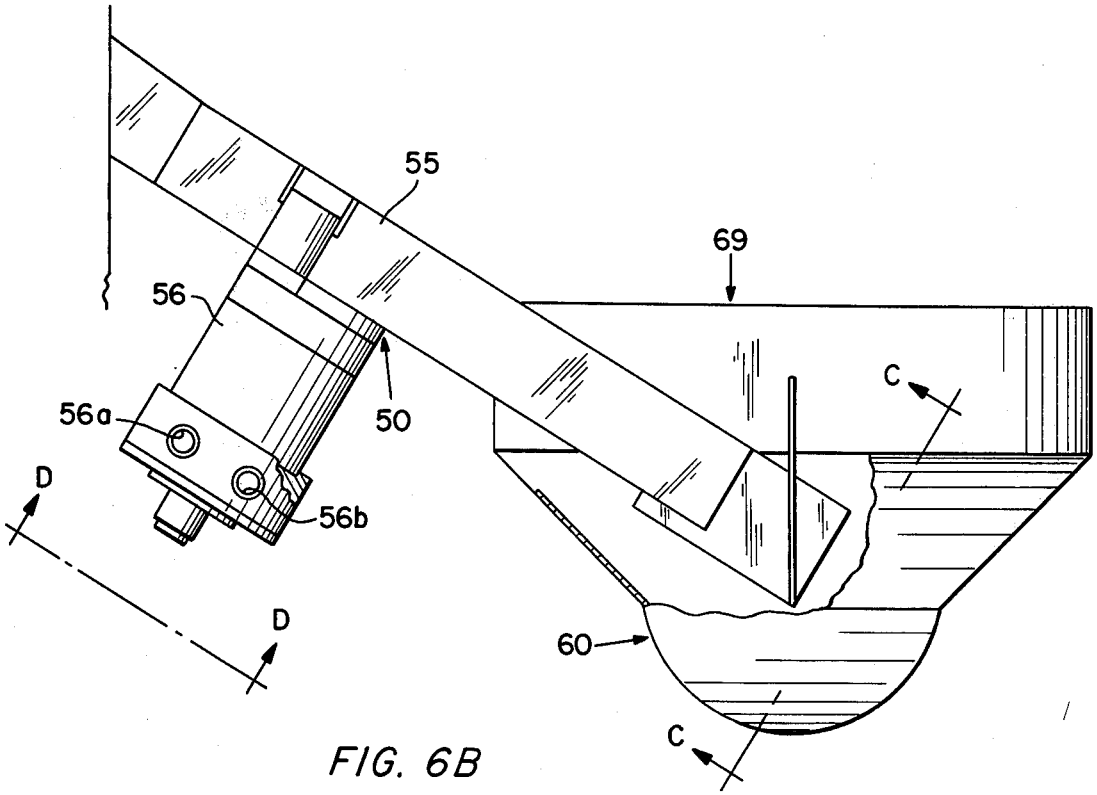
FIG. 6B is a diagrammatic side view of the assembly of FIG. 6A, particularly illustrating a gate control mechanism and also showing the relationship of the gating assembly to a dedusting assembly.
Figure 6D:
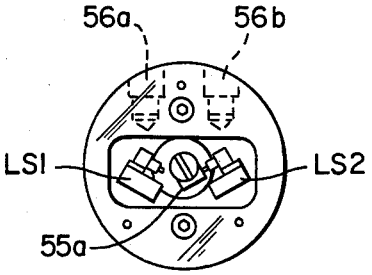
FIGS. 6C and 6D are diagrammatic views of the gating assembly of FIG. 6B, taken respectively in the directions C—C and D—D.
Figure 6C:
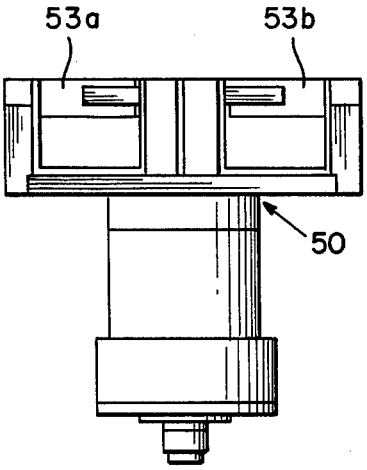

Tablet movement along the U-shaped parallel chutes 53*a* and 53*b* is provided primarily by gravity in view of the incline of the diverting gate assembly 50 relative to the horizontal. From there the tablets fall into a substantially equi-sided hopper device 69 (FIGS. 6B and 7A) which is appropriately sectioned to guide the tablets into a corresponding one side or the other of a deduster arrangement 60.

Figures 7A, 7B, 7C:
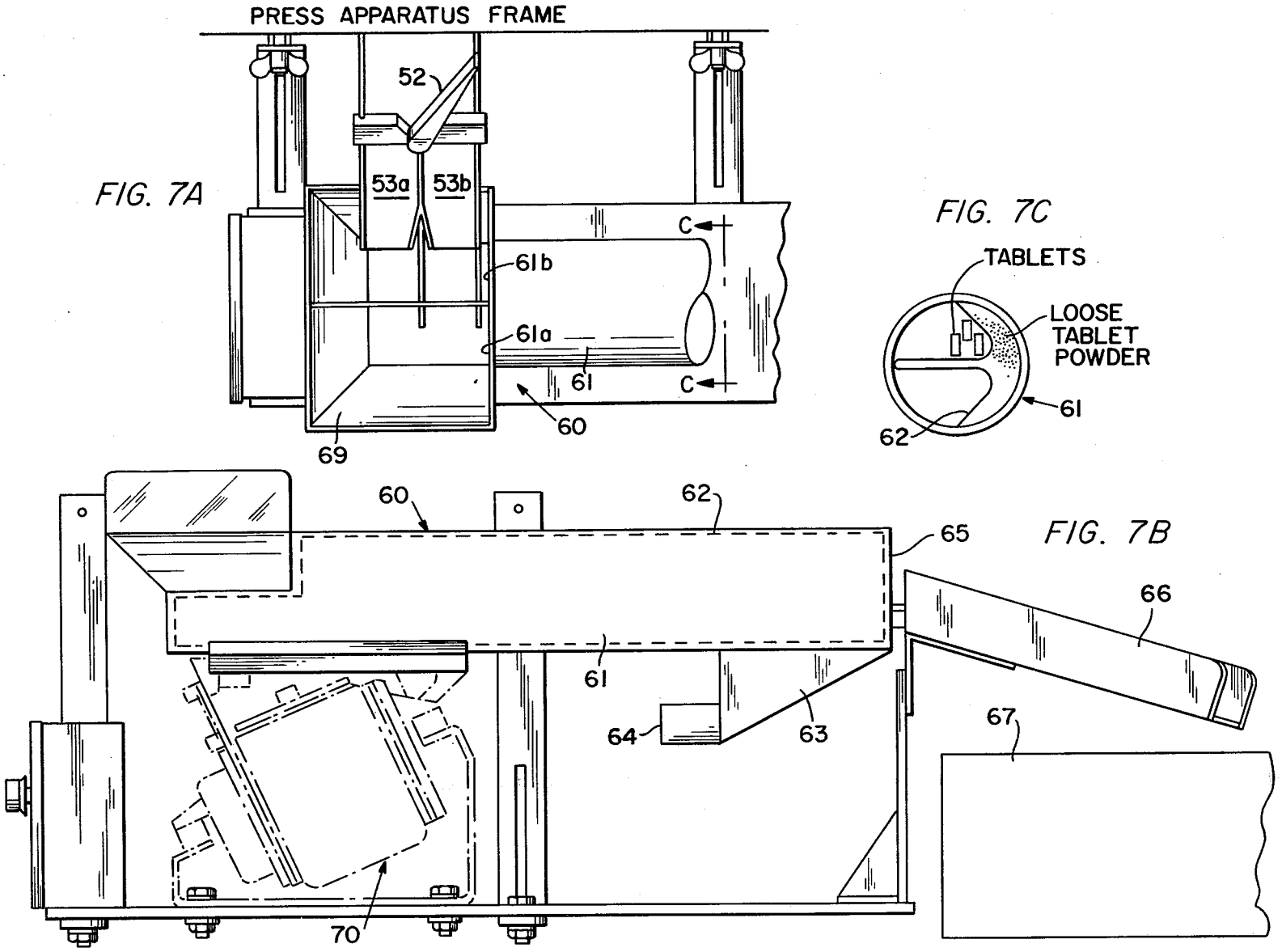
FIG. 7A is a diagrammatic plan view of a portion of the deduster assembly shown in its relationship to the gating assembly.
FIG. 7B is a diagrammatic side view of the complete deduster assembly shown in FIG. 7A, including an output chute arrangement and vibrator arrangement.
FIG. 7C is an end view of the tubular portion of the assembly of FIG. 7A taken in the direction C—C.

The deduster arrangement includes a tubular member (61) horizontally arranged which is partitioned over its entire length by a horizontally-arranged wire mesh screen trough 62 shown in FIG. 7B and FIG. 7C which permits the loose tablet powder to fall to the bottom of the tubular member 61 while the tablets move along the length of screen trough 62 under the inducement of a vibrator arrangement 70. Screen trough 62 is so shaped as to form also a vertical partition as shown in FIG. 7C, thus forming respective channels 61*a* and 61*b* in operative arrangement with chutes 53*a* and 53*b*. While the powder vibrates into an excess powder catcher 63, which is vacuum-returned to the powder source via vacuum line 64 (FIG. 7B), the tablets are vibrated out the far end 65 of the tubular deduster trough 61 and into a downward sloping chute 66 to fall into a container 67, such as a cardboard box.

Vibrator assembly 70 constitutes a state-of-the-art arrangement wherein the vibrating element is mechanically coupled to the deduster assembly 60 from underneath.

Chute 66 in FIG. 7B is actually representative of one of a pair of such chutes associated respectively with the two channels 61*a* and 61*b* of the deduster trough 61 (see FIG. 1B).

For as long as the tablet counts are proceeding toward the preset limits stored in the above-described settings of the counter 1*a*, the system does not alter from the operation as above-described, as to either side of the apparatus. However, once the preset count (e.g. 180,000 tablets) is reached in the counter pertaining to one side of the machine or the other, the counter (FIG. 2) sends out a signal on the five-wire cable leading to the multiterminal connector 6 associated with that side of the apparatus. This signal actuates one of the valve solenoid arrangements 21 of the actuator valve assembly 2 controlling the gate position on that side of the machine. This causes the gate to swing over to its other position so that the tablets will be caused to follow the alternate path provided in the gate assembly and the deduster assembly to eventually be directed down the associated alternate chute 66 into a new empty container situated thereunder. Simultaneously, an alarm is provided by the counter console arrangement 1 alerting the operator that the full container situated under the now deactivated chute 66 needs to be removed and an empty replacement container placed under that chute. The contemplated preferred gate arrangement here is pneumatically operable, as will be described in greater detail hereinafter.

Provided in the particular gate actuator arrangement 8, as mentioned before, is a limit switch arrangement 11 consisting of microswitches $LS_1$ and $LS_2$, whereby the counter console arrangement 1 is informed as to whether the gate, in switching over when the signal as transmitted to the appropriate connector 6, made a full and complete switching. This information is, of course, transmitted to the counter console arrangement 1 by the orientation of limit switches $LS_1$ and $LS_2$ for that side of the machine which are interpreted following a delay pre-established in the circuitry of counter arrangement 1. The orientation of the limit switches is transmitted to the counter arrangement via the A, B and C leads running from the limit switches to the counter console arrangement 1 through connector 6. If, after the pre-established delay there is determined that the gate unsuccessfully converted, an alarm provided by the counter console arrangement 1 is actuated.

It is well within the scope of this invention to provide, moreover, that in conjunction with this alarm, the switch 14 of the appropriate deduster control 12 open up, thus, effectively stopping a continued vibration of assembly 70 and the corresponding further filling of the already full container, as represented by the reaching of the preset number on the thumbwheel switch which caused the gate to be fired in the first place.

Provision may be made also for the newly formed tablets now rapidly accumulating in the gate and deduster assemblies to be taken care of. Very simply, this alarm signal, indicating unsuccessful conversion of the gate, could actuate a trap door arrangement (not particularly shown) situated in the base of the trough of the gate assembly, i.e. portion 51 (FIG. 6A), just prior to the gate 52 itself, wherein the door drops open thus allowing the tablets to fall into a catch container. This catch container could be of the type that may be easily removed by the operator in order to dump the accumulated tablets therein into the gate assembly after the trouble has been cleared.

Figure 3:
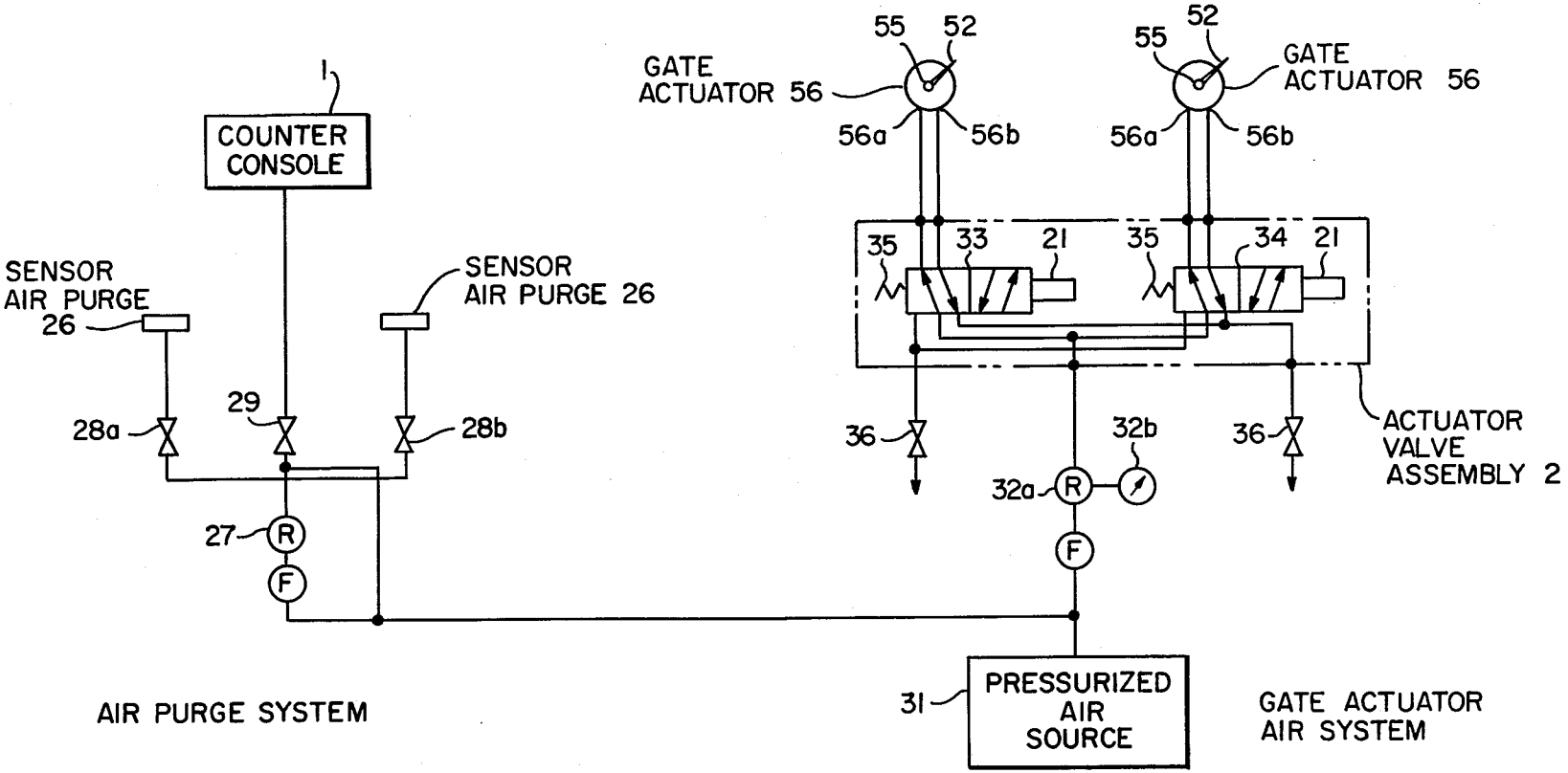
FIG. 3 is a schematic illustration of the pneumatic circuitry aspects of the invention in association with the apparatus depicted in FIGS. 1A and 1B.

Referring more closely to FIGS. 6A–6D, in conjunction with FIG. 3, it may be appreciated that gate 52 is pneumatically operable. Mechanically, gate 52 is pivoted between two limit stops 54*a* and 54*b*, the latter being arranged on the trough 57 of the gate assembly 50 so as to allow the tablets to pass thereunder. Gate 52 possesses a resilient tip portion 52*a*, which is more fully described below. Gate 52 is pivoted on a shaft 55 extending from a pneumatic control assembly 56, such as a Excello Rotac S-1252-V. At the opposite end of shaft 55 there is provided the limit stop arrangement (see particularly FIG. 6D) mentioned hereinbefore, wherein micro-limit switches $LS_1$ and $LS_2$ are mounted proximate to shaft 55 so as to appropriately engage a cam extension 55*a* thereof. This arrangement may be termed "end-camming" wherein if the gate fails to reach its end position in a switching action, there will fail to result an engagement of the cam 55*a* with the appropriate micro switches, thus giving rise to the actuation of the alarm.

The Excello Rotac unit will not be explained in greater detail herein. Suffice it to say that it is operative via reversible pneumatic flow paths 56*a* and 56*b* leading into the unit. This arrangement readily lends itself to return-flow control, such as air volume control, wherein the gate control assembly 56 is capable of providing dampened movement so that the firing of gate 52, causing it to change positions, will not result in a destructive collision of the gate with the limit stop toward which it approaches, which in turn prevents the associated limit switch from receiving a harmful shock.

It will be appreciated that there is very little dimensional length to the mouth portion 51 of the gate assembly in front of (or preceding) the gate 52. The closer the gate arrangement itself is to the point where the tablets are sensed (and therefore counted), the lesser the possibilities are of discrepancies occurring in the count. While the counter console arrangement 1 does have a settable delay provision therein specifically capable of compensating for the dimensional separation between the sensing point and the gate, the need therefore is minimized by having the gate as close to the tablet sensing as possible, as here, within practical and structural limitations. This delay provision encompasses an adjustable range of up to one second to compensate for the separation between the point of sensing and the location of the gate.

The gate 52 is tapered not unlike a wedge wherein it is pivoted proximate the wider end. Attached to the other end, i.e. the so called free end, is a piece of resilient material 52*a*, which may be an elastomeric member composed of, for example, teflon, nylon, polypropylene and the like, appropriately tailored to fit unto the narrow or free end portion of the gate and extend sufficiently to have its free end be just in contact with one of the side walls of the U-shaped trough portion 57 when the gate 52 is in either of its two intended positions.

The purpose of resilient piece 52*a* is to take into consideration the case where a tablet gets caught between the gate and the side wall of the trough when the gate switches from one position to the other. With the resilient piece 52*a*, this portion of the gate is able to deform around the tablet and as much as possible make contact with the side wall in order to prevent other tablets from forcing themselves into the wrong path and thus render inaccurate the count. As for the tablet which is caught, the resilient piece will hold it in place without crushing it and thus preserving it and maintaining the accuracy of the count. Should the gate be jammed by tablets sufficiently to prevent the gate from achieving a fully switched position as determined by the limit switches $LS_1$ and $LS_2$, this would, of course, trigger the aforementioned alarm, which would bring the operator to an awareness that a gate jam exists and also could invoke the precautions mentioned above to preserve an accurate count notwithstanding the continual accumulation of tablets from the press.

The right half of the pneumatic schematic diagram of FIG. 3 is concerned with the gates 52. As shown in FIG. 3, pressurized air for pneumatic operation is provided from an outside source 31. The air is passed through a filter and a pressure regulator 32 (typically 0–100 psi control) having a gauge 32*a*. The pressurized air line splits at the junction shown and is fed to both the valve mechanisms 33 and 34 associated respectively with the two gates 52. Each valve mechanism is provided with a two-part movable main body which has a pair of air paths associated with each part. The main body is in movable association with a spring 35 and the solenoid 21 and is thus moveable to one of two possible positions. A change from one position to the other causes the pneumatic flow to reverse, and thereby gate 52 to change position. For a greater understanding of this actuator valve assembly, reference may be made to the assembly Model No. 11SAD421 assembly produced by Numatics Inc.

It will be appreciated that the two exhausts for the assembly are controlled by needle valves 36. In this way, the volume of air escaping during a switching of a gate 52 is controlled so as to provide damped switching. Needle valves 36 as well as pressure regulator 32*a* provide, in conjunction with the pneumatic arrangement disclosed, a more reliable, easily controlled and long-lasting gating arrangement, which ensures non-destructive accurate and complete switching. These properties are not all available via other arrangements, such as electromagnetic gate switching arrangements.

Electromagnetic gate switching, in contrast, has the properties that there is presented only one unadjustable speed of switching, whereas this switching speed is hard to maintain with consistency due to the amount of force needed for a switching operation varying from time to time. Moreover, arrangements of this type switch with such rapidity as to make it impracticable to reliably and inexpensively control the deceleration of the gate as it concludes a switching action, in order to prevent a distinctive collision with the limit stop.

Reference is now made particularly to FIGS. 4A–4D and 5A and 5B for a more detailed discussion of the optical sensing arrangement giving rise to the generation of pulses to be counted. Firstly, it will be appreciated again that the optical sensing device being employed here is of the retroreflective type. That is, a signal is generated therefrom whenever a threshold percentage of light emitted by the device is reflectively received thereby in the form of diffuse reflection off the near edge side of the tablets. It is intended herein, of course, that this threshold not be reached except when a tablet is properly formed by the tablet press apparatus. For accuracy sake, it is intended that detection of a properly formed tablet occurs when the tablet is substantially fully ejected from the die table. The latter is desired as sensing here is as close to the actual completed production of the tablets as possible. A more complete understanding of a retroreflective optical center device usable in the invention may be gained by making reference to the Model No. S-322-3 manufactured by Skan-a-matic Corp. As fractionally shown in FIG. 4A (and to a certain extent in FIG. 5B) the rotating die table 20, is horizontally arranged, with a center of rotation 20A and a multiplicity of dies 22 proximate the periphery thereof.

Arranged above the rotating dies, which are rotating clockwise herein as indicated by the arrow 20*b*, is one of the two system optical sensors 10. The other is arranged 180° from the one shown, in relation to the press die table 20. The sensor 10 is directed at the dies 22 at a particular angle $\alpha$ (FIGS. 5A and 5B) which has been empirically determined to be optimally between 18° and 30° relative to the horizontal. This angle is particularly viewed in FIGS. 4B, 4D, 5A and 5B.

The assembly housing the optical sensor is comprised of a mounting member 23 suitably mounted to one of the columns of the press apparatus via screws 23*c*. Slidably arranged on the mounting member 23 is an adjustable angled arm 24. The latter is held primarily by slip lock means 23*a* and is laterally adjustable in position by angled arm lateral screw adjustment 23*b*, which includes a jam nut locking means. Arm 24 is angled primarily for the convenient use of mounting the sensor assembly on the nearby press column in an orientation that properly presents the optical sensor to the die table 20.

The free end of arm 24 is pivotably coupled to a sensor and air purge mounting arrangement 25, wherein arm 24 is provided with pivot 24*a*. The arrangement 25 is provided with a spring-loaded bias tension means 25*a*, which essentially includes a spring-encapsulated screw adjustement engaging the free end portion of arm 24. Its purpose is to provide a spring-loaded safety release in case the mounting arrangement is caused to be temporarily struck or otherwise pulled or yanked out of position. In this way the mounting arrangement can pivot about 24*a* harmlessly against the spring-bias of 25*a* in the face of a disturbing torque, and immediately return to the normal pre-established position without damage to the arrangement 25 or to the entire mounting assembly. Member 25 is also provided with a fine screw adjustment 25*b* for aligning itself about pivot 24*a* relative to the dies 22. By this adjustment, coupled with adjustment means 23*b* and the location of screws 23*c*, there is provided an adjustable positioning scheme to properly orient the optical sensor relative to the newly formed tablets as they eject from their dies.

Figure 5A:
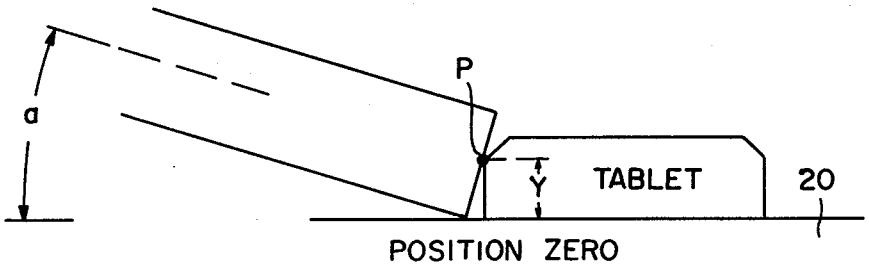
FIGS. 5A and 5B schematically illustrate in reference and operational orientations respectively the physical relationships between the optical sensor and an object to be sensed and counted.
Figure 5B:
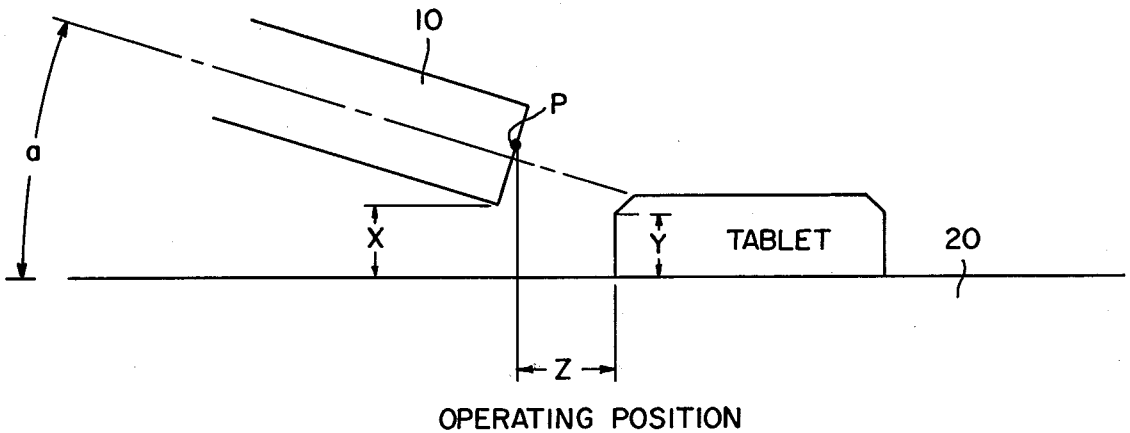

As may be best seen in FIG. 4D, in conjunction with FIGS. 5A and 5B, the sensor 10 is fixedly angled relative to the horizontal. Several factors ultimately figure in the optimum range of values for this angle $\alpha$, including the tablet size, the height of mounting arrangement 25 above the press die table 20, reflecting capabilities of the tablets as they eject from their dies, and so on. The sensors employed herein such as, for example, the type above-identified, desirably peak in the infra-red light range; thus problems with ambient visible light are largely eliminated.

Since the sensing here is optical in nature, and the material from which the tablets are pressed is a powder, there is the constant danger of excess powder forming a film on the face of the sensor, and thus yielding eventually an inaccurate count. In accordance with the invention, therefore, there is provided air purge means 26 arranged in association with the sensor 10 proximate the operative face thereof, for continually flushing this face with positively pressurized air.

In FIGS. 4A–4D there is shown a pressurized air purge inlet 26A which couples to a tubular member 26*b* fixedly angled through member 25 in the same manner of orientation as the sensor 10. The tubular member 26*b* ends in a largely hollow L-shaped piece 26*c* which has proximate its end a circular aperture or hole (not particularly shown) to allow piece 26*c* to slip over the end of the sensor 10 and create an apertured canopy or envelope forming a cylindrical recess 26*d* at the end of the sensor. As may be perhaps best seen in fractionalized schematic form in FIGS. 4D and 4E, that portion of piece 26*c* constituting the canopy portion contains a wall slot 26*e*, i.e. a communication between piece 26*c* and that portion constituting the canopy as regards the pressurized air. The purging air for flushing the sensor face is introduced by way of this wall slot. The width dimension of this narrow slot is predetermined, based on the preferred air pressure employed as controllably derived via the air purge means 26, so as to provide sufficient flushing or purging action of the sensor face without creating disturbing air currents in the surrounding vicinity, such as might stir up excess loose powder nearby. The length dimension and location of the slot in the canopy wall, in turn, controls to a certain extent the pressurized flow of flushing air outward from the recess and the sensor face in a uniform plane wave front, as demonstrated in FIG. 4E by the arrows. These two structural factors of the narrow slot are also predetermined and take into account the preferred air pressure employed. By the arrows in FIG. 4E it is shown that the pressurized air, in entering the canopy via the narrow side wall slot is initially directed toward the opposite side of the canopy. From there it dispurses in a diverging pattern throughout the canopy to emerge as a substantially continuous and uniform pressure wave front found in aperture 26*d*.

The air purge system may be even better understood by referring to FIG. 3, wherein the left side of this pneumatic schematic illustration is directed to the air purge system. As shown, the outside source of pressurized air 31 is coupled through a filter, a pressure regulator 27 and a needle valve 28*a* or 28*b* to air purge means 26 respectively associated with the two counter sensors 10 in the example embodiment here contemplated. Element 27, of course, regulates the air pressure at the slot 26*e* of air purge means 26, and together with adjustable needle valves 28*a* and 28*b*, which control the volume of air to the respective air purge means 26, provide excellent control of the positive air pressure flushing action in generating a continuous substantially uniform wave front emitting from the aperture at 26*d* which ensures a clear sensor face without adverse pneumatic side effects. The air purge system shown in FIG. 3 also includes a by-pass coupling around the filter and regulator to a third adjustable needle valve 29 which leads to the counter console arrangement 1. In this way there is ensured that the control/counter equipment 1 is kept virtually free of troublesome dust and loose tablet powder by positively pressurizing the interior of the console.

Also provided with the sensor/air purge mounting arrangement are a dust shield/scraper member 36 and a vacuum particle remover 37 (FIGS. 4A–4C). Since we are concerned in this example tablet press apparatus initially with a powder substance, it will be appreciated that in the formation of tablets therefrom, there will result a certain amount of excess powder associated with the die table. This powder tends to follow the rotary motion of the die table, and consequently the movement brings the excess powder into proximity with the operative end of sensor 10. It is desired, therefore, to eliminate the presence of this powder in the vicinity of the sensor as much as possible. Thus, shield 36 is provided in front of the sensor 10 relative to the direction of rotation of die table 20. It basically deters the rapid movement of the powder and allows only a fractional amount thereof at any one time to advance to the vacuum particle remover 37. The latter, of course, is strategically positioned behind the member 36 to readily capture virtually all powder particles advancing beyond the member 36 in the vicinity of the sensor 10. Also, vacuum means 37 is functionally arranged so as not to create any disturbing air currents relative to the formation or sensing of the tablets.

Optimum positioning of each of the two sensors 10 is accomplished with reference to the stations associated with the die table where the tablets are approximately 90% ejected from their dies. These "sensing stations" enable a zero-position to be defined as a reference between the sensor 10 and a practically fully ejected tablet (FIGS. 5A) on which final optimum positioning of the sensor relative to the almost fully ejected tablets may be identified. The sensor face is, in the zero-position, in contact with the tablet (as shown in FIG. 5A) to define a point P on the sensor face and also a dimension Y which corresponds to the height of the exposed tablet above the rotary die table relative to the point of contact between tablet and sensor at P when the tablet is practically fully ejected.

The angle $\alpha$ which, as aforesaid, may be adjusted optimally between 18° and 30° depending, for example, on the tablet shape and its ability to reflect light, is generally fixed ahead of time with regard to the sensor mounting arrangement, as is, for instance, depicted in FIGS. 4A–4D; however, it is to be noted that it would be entirely within the scope of this invention to provide on the sensor mounting arrangement mechanical or other adjusting means to permit a direct control adjustment as to this angle $\alpha$.

It may be seen from FIGS. 5A and 5B that when the sensor has been established at its final position setting (FIG. 5B), point P on the face of the sensor lies approximately a distance Y above the lowest point of the sensor face. This lowest point is in turn a distance X above the die table. The dimension X has been empirically determined to yield optimum sensing results in conjunction with the other sensor setting parameters in the range of 0.5 mm ± .1mm. Dimension Z, on the other hand, is a measurement of separation between the vertical projection of point P of the sensor face onto the surface of the die table and the nearest edge of the sensed tablet. Dimension Z has been found empirically to optimize sensing within the range of 4 mm ± 1.5 mm.

It should be noted that dimension Z is directly varied by pivot adjustment **25*b* (FIG. 4A). Dimension X, however, is largely controlled in the arrangement depicted in FIGS. 4A–4D by the height above the plane of the die table 20 at which the sensor mounting arrangement is secured to the press column via screws 23*c*. It is to be also noted here, however, that it is well within the scope of this invention to provide in place of simple screws 23*c*** a state of the art vertical adjustment to provide more articulate control of the dimension X.

Figure 8C:
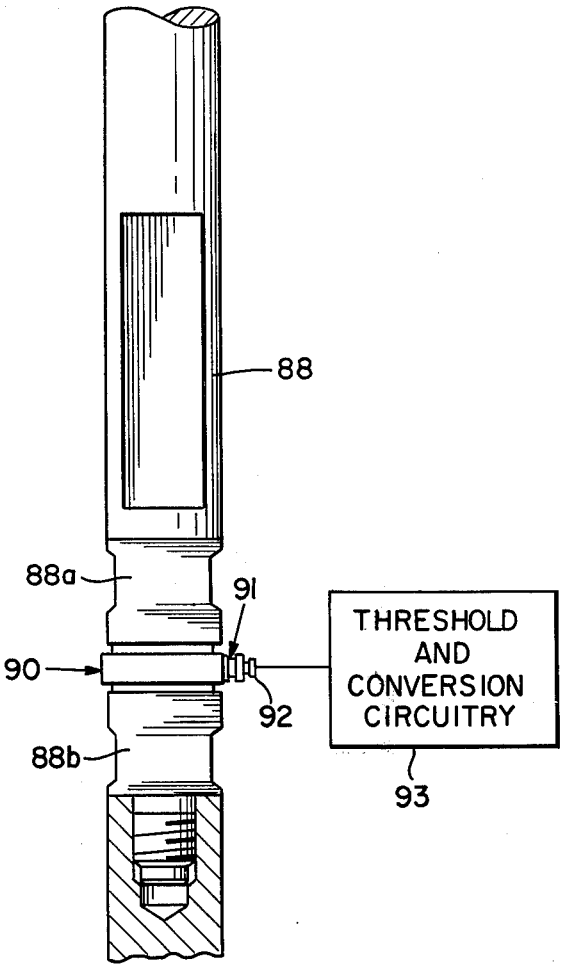
FIG. 8C is an enlarged diagrammatic illustration of the portion of the arrangement of FIG. 8A in direct communication with a strain gauge type sensing arrangement according to the invention.
Figure 8A:
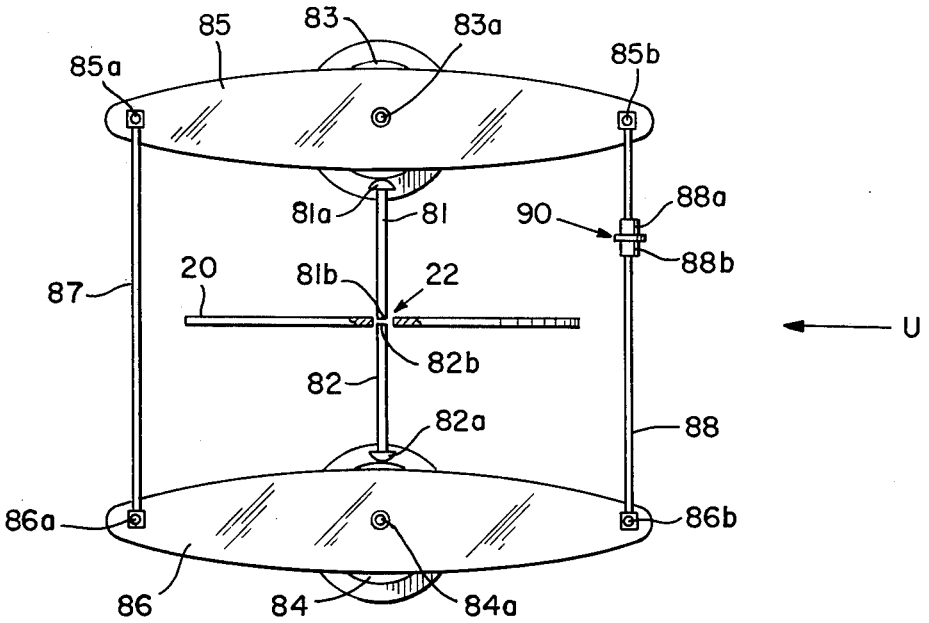
FIG. 8A is a schematic representation of a portion of an example rotary tablet press apparatus illustrating a preferred adaptation of a tablet sensing system using the strain gauge sensing technique.
Figure 8B:
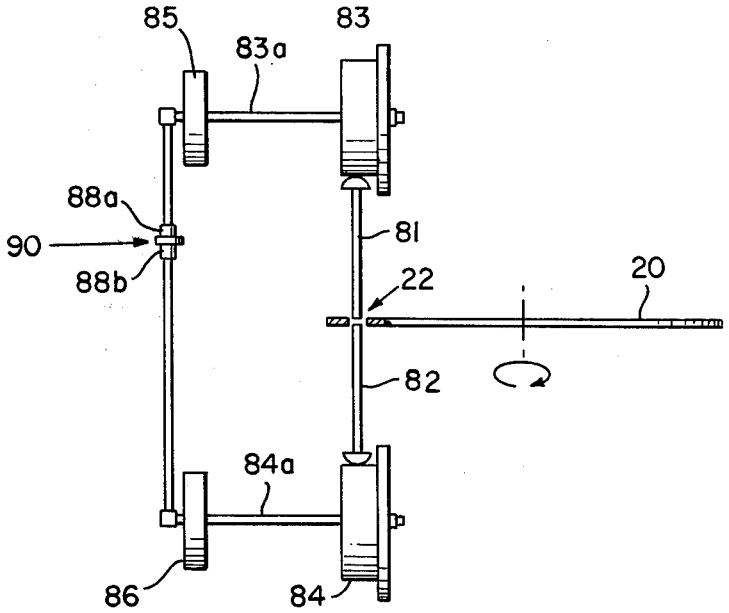
FIG. 8B is a side view of the arrangement depicted in FIG. 8A taken in the direction of the arrow U.

Turning now to the schematic representations in FIGS. 8A and 8B of the example tablet press apparatus depicted in this application, FIG. 8A is a side view of the press along the plane of the die table 20 but fronting on one of the two positions 180° opposite one another wherein a tablet achieves maximum pressing, and is, therefore, substantially fully formed. FIG. 8A is a view of the arrangement of FIG. 8A taken in the direction of the arrow U.

Operationally, the tablet die table 20 rotates in a clockwise direction (as shown by the arrow) as viewed from above. The upper and lower punches 81 and 82 (one pair of punches for each die hole in table 20, with only one being shown herein) of each pair of punches also rotate with the table 20 and are controlled in their forward and retracting motions by a more or less circular cam track (not particularly shown). However, as the punches 81 and 82 approach the point where the tablet powder deposited in the die hole corresponding thereto is to be pressed into a tablet, the punch heads **81*a* and 82*a* respectively come in contact with cylindrically shaped upper and lower press wheels 83 and 84, which have a shape not unlike that of a railroad car wheel. These two wheels are rotatable but otherwise stationary about respective shafts 83*a* and 84*a*, which in turn are coupled respectively to upper and lower elongated elliptical-shaped members 85 and 86. Members 85 and 86 are pivotably coupled together by way of a pair of tie rods 87, 88 at pivots 85*a*, 85*b* and 86*a*, 86*b*. Tie rod 87 is of fixed length, whereas tie rod 88 includes a pair of adjustments, i.e. upper and lower adjustments 88*a* and 88*b*. Adjustments 88*a* and 88*b* have the ability to control the maximum powder compression achieved between the punched tips 81*b* and 82*b***.

An alternative arrangement for sensing tablet production, i.e. a strain gauge sensing arrangement, may now be seen. Adjustments **88*a* and 88*b* may be provided with a pressure-sensitive or load washer type of arrangement 90 therebetween, capable of being prestressed by the adjustments 88*a* and 88*b*. These adjustments are in essence preload adjustments introducing positive strain on the washer arrangement 90**.

By the arrangement, as described above, there results evenually from a pressing operation back pressure on the punch tips **81*b* and 82*b* from the formed tablet which translates to a spreading force being felt on members 85 and 86 trying in essence to separate shafts 83*a* and 84*a*. This, in turn, develops a counterstressing on the tie rods 87 and 88. Thus, a pressing action of the apparatus relieves or relaxes the preload conditions on the washer 90**, which is readily detectable.

It is most important to note that unless a correct amount of powder is successfully pressed into a tablet, there will not result a sufficient reduction of the prestressing to trigger a detection. Naturally, a certain empirically determined threshold is preliminarily established to ensure that only correctly made tablets are sensed in this manner.

Reference is now made to FIG. 8C which shows in an enlarged diagrammatic side view the washer and adjustment arrangement of tie rod 88. Upper and lower adjustments **88*a* and 88*b* are shown separated by the washer-shaped strain gauge sensing arrangement 90. In actuality, arrangement 90 is comprised of a donut-shaped piezoelectric material protectively covered by an outer steel band. At a point 91, two leads are brought out from the piezoelectric material through the steel covering to be in communication with coupler 92. From there, leads are run to threshold and conversion circuitry 93 which provides the signal threshold adjustment and determines whether the electrical variations derived from the lessening of mechanical constriction on the washer arrangement 90 are sufficient (i.e. a tablet has been correctly pressed) or insufficient (i.e. for whatever reason, such as insufficient powder, a tablet was not formed successfully). This, of course, translates in the former case to a count which is picked up by the counter arrangement 1*a*. The threshold and conversion circuitry 93** contemplated herein is of a conventional nature within the state of the art.

In place of the piezoelectric pickup, it is within the scope of this invention to provide a semiconductor or resistive device of the type from which changes in resistance, as opposed to the potential variations provided by the piezoelectric arrangement, are readily detectable from an induced strain in arms 87 or 88.

Reference in the above was made to the fact that sensing could also be accomplished by means of a fluidic sensing arrangement. Such an arrangement is contemplated in this invention, wherein the same would be arranged substantially in the same operative location as the aforedescribed optical sensing arrangement in regard to the almost fully ejected tablets. Any state of the art fluidic type sensing arrangement suitable to detection in the above-described environment would be applicable. As state of the art fluidic sensing arrangements are contemplated, and since the same would be positioned in a similar manner to the optical sensing arrangement relative to the ejecting tablets, a fluidic sensor per se is not particularly shown in the drawings. Operationally, however, the fluidic sensing arrangement at each "sensing station" would comprise means for providing a directed narrow stream of air aimed toward a respective one of the stations of the die table 20 at which the tablets are substantially fully ejected. In this manner when such a tablet passes in front of this directional air stream, it would tend to create a change in pressure which would be readily sensed by the unit. The arrangement, for example, could be one wherein a pressure sensor arranged directly opposite the stream of air would yield a count whenever a tablet effectively, i.e. sufficiently, blocked the air stream, which would happen at the point at which the tablet is almost fully ejected. It is, of course, well within the scope of this invention to utilize any other suitable fluidic type sensing arrangement.

What is claimed is:

1. An ultra-accurate counting and handling system for use with high-speed apparatus making discrete, solid particular objects, comprising:

a. sensing means including a directional sensor arrangement predeterminably arranged relative to each station of the apparatus at which the formation of the objects is virtually completed, each said sensor arrangement including a retroreflective optical sensor arranged to have an operative face thereof proximate said respective station of the apparatus at a pre-established optimum sensing angle $\alpha$ relative to the virtually completed objects, said sensing means further including a spring-loaded mounting mechanism associated with each said sensing arrangement for housing the sensor and providing adjustable stationary mounting of the latter relative to the said respective station of the apparatus;

b. control counter means responsive to said sensing means for providing a continuous count of the objects sensed by each said sensor arrangement, said counter means including first means enabling a presetting of the maximum desired count of sensed objects for each said station of the apparatus;

c. gating and handling means including a gated dispensing arrangement associated with each said station of the apparatus and having a first portion thereof situated proximate the said respective station, each said gated dispensing arrangement being adapted to predeterminably control the procession of the objects from said respective station of the apparatus to a pre-established destination under the supervision of said first means.

2. The system according to claim 1 wherein at least one mounting mechanism includes means for providing at least two-way adjustability of the associated sensor arrangement relative to the objects to be sensed, in which one of said two ways constitutes a pivotal adjustment.

3. An ultra-accurate counting and handling system for use with high-speed apparatus making discrete, solid particular objects, comprising:

a. sensing means including a directional sensor arrangement predeterminably arranged relative to each station of the apparatus at which the formation of the objects is virtually completed, each said sensor arrangement including a retroreflective optical sensor arranged to have an operative face thereof proximate said respective station of the apparatus at a pre-established optimum sensing angle $\alpha$ relative to the virtually completed objects, said sensing means further including a spring-loaded mounting mechanism associated with each said sensing arrangement for housing the sensor and providing adjustable stationary mounting of the latter relative to the said respective station of the apparatus;

b. control counter means responsive to said sensing means for providing a continuous count of the objects sensed by each said sensor arrangement, said counter means including first means enabling a presetting of the maximum desired count of sensed objects for each said station of the apparatus;

c. gating and handling means including a gated dispensing arrangement associated with each said station of the apparatus and having a first portion thereof situated proximate the said respective station, each said gated dispensing arrangement being adapted to predeterminably control the procession of the objects from said respective station of the apparatus to a pre-established destination under the supervision of said first means, each said gated dispensing arrangement including a gate assembly adapted to receive the objects from the said respective station of the apparatus, said gate assembly being comprised of guide means positioned for directing said completed objects away from said station, a chute arrangement a first portion of which is arranged proximate said guide means to receive the objects from the latter, and a gate mechanism arranged relative to said chute arrangement for controllably directing movement of the objects through said chute arrangement.

4. The system according to claim 3 wherein said chute arrangement has at least two defined paths of movement for the objects, and wherein said gate mechanism includes a gate positioned proximate said guide means for directing the objects to one or the other of said paths of said chute arrangement under the control of said first means.

5. The system according to claim 4 wherein said gate is pivotably mounted proximate one end thereof, and wherein the other end thereof includes an elastomeric member adapted to permit a switching of said gate which is non-destructive as to the objects.

6. The system according to claim 5 wherein said elastomeric member is constructed and arranged relative to said at least two paths for preventing an inaccuracy from developing between the number of objects entering a pre-established one of said at least two paths and the count established in said control counter means associated therewith, even in the event said gate is unable to fully complete a switching movement due to the jamming presence of one or more of the objects.

7. The system according to claim 3, wherein said control counter means further includes adjustable delay means adapted to preserve the accuracy of the system in counting and handling the objects by compensating for the separation distance between said gate and said respective station of the apparatus at which sensing of the objects is occurring.

8. The system according to claim 3 wherein said gate assembly includes pneumatic valve means responsive to said first means for effecting a switching of said gate mechanism.

9. The system according to claim 8 wherein said gate assembly further includes a limit stop arrangement adapted to define the switching positions of said gate mechanism.

10. The system according to claim 9 wherein a first position of said limit gate causes electrical communication with said control counter arrangement for enabling a determination by the latter of whether a switching movement of said gate mechanism was successfully completed following actuation thereof in response to said first means.

11. The system according to claim 9 wherein said limit stop arrangement includes a pair of limit switches coupled to said first means, said pair of limit switches being positioned relative to said gate mechanism so as to enable a definition of the instant orientation of said gate mechanism as the latter affects the movement of objects through said gate assembly.

12. The system according to claim 11 wherein said gate mechanism includes a pneumatically operable gate arranged to be pivoted on a shaft, said shaft being controllably moveable in response to said pneumatic valve means, and wherein said shaft is provided with a camming surface situate in operative proximity to said limit stop arrangement for active engagement therewith.

13. The system according to claim 11 wherein said control counter arrangement further includes alarm means responsive to said limit stop arrangement and to said first means for generating an alarm whenever a failure is detected of said gate mechanism to achieve a complete switching movement responsive to said first means following attainment of the preset count established for the said respective station of the apparatus.

14. The system according to claim 8 wherein said gating and handling means further includes pneumatic volume and pressure control means for adjustably controlling the switching speed of said gate mechanism.

15. The system accdording to claim 14 wherein said gate mechanism includes a gate and said gate assembly further includes a limit stop arrangement adapted to define the switching positions of said gate mechanism, and wherein said pneumatic volume and pressure control means is adapted to provide a dampening of the gate mechanism switching speed to pevent thereby a destructive collision of said gate with said limit stop arrangement.

16. The system according to claim 3 wherein said gate assembly further includes second means, responsive to said first means and adapted to be in operative arrangement with said first portion of said chute arrangement, for temporarily diverting the objects received by said gate assembly from the said respective station away from said gate mechanism prior to the objects reaching same, whenever a gate mechanism malfunction is detected by said first means.

17. The system according to claim 3 wherein each said gate assembly chute arrangement has at least two defined paths of movement for the objects, and wherein said first means includes gate actuation control means for causing, in response to an attainment of the preset count established in said first means for a particular said station of the apparatus, said gate mechanism to undergo a switching movement resulting in the objects being then diverted to an alternate one of said at least two paths of said chute arrangement.

* * * * *